US009931692B2

(12) United States Patent
Sugiura

(10) Patent No.: US 9,931,692 B2
(45) **Date of Patent: *Apr. 3, 2018**

(54) HOISTING TYPE CONTINUOUS CASTING DEVICE, HOISTING TYPE CONTINUOUS CASTING METHOD, AND SOLIDIFICATION INTERFACE DETECTION DEVICE

(71) Applicant: TOYOTA JIDOSHA KABUSHIKI KAISHA, Toyota-shi (JP)

(72) Inventor: Naoaki Sugiura, Anjo (JP)

(73) Assignee: TOYOTA JIDOSHA KABUSHIKI KAISHA, Toyota-shi (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/646,978

(22) PCT Filed: Sep. 30, 2013

(86) PCT No.: PCT/JP2013/005823

§ 371 (c)(1),
(2) Date: May 22, 2015

(87) PCT Pub. No.: WO2014/080559

PCT Pub. Date: May 30, 2014

(65) Prior Publication Data

US 2015/0298205 A1 Oct. 22, 2015

(30) Foreign Application Priority Data

Nov. 22, 2012 (JP) ..... 2012-256512

(51) Int. Cl.
*B22D 11/01* (2006.01)
*B22D 11/14* (2006.01)
(Continued)

(52) U.S. Cl.
CPC ..... *B22D 11/01* (2013.01); *B22D 11/124* (2013.01); *B22D 11/145* (2013.01); *B22D 11/20* (2013.01);
(Continued)

(58) Field of Classification Search
CPC ..... B22D 11/01; B22D 11/145; B22D 11/22; B22D 11/20; B22D 11/124; B22D 41/00; B22D 46/00
See application file for complete search history.

(56) References Cited

U.S. PATENT DOCUMENTS 4,515,204 A * 5/1985 Ohno ..... B22D 11/10 164/338.1
5,757,506 A * 5/1998 Tabatabaei ..... B22D 11/18 164/4.1
(Continued)

FOREIGN PATENT DOCUMENTS

CN 1045718 A 10/1990
CN 101377008 A 3/2009
(Continued)

OTHER PUBLICATIONS

International Search Report dated Nov. 5, 2013 in PCT/JP2013/005823.
(Continued)

*Primary Examiner* — Kevin P Kerns
*Assistant Examiner* — Steven S Ha
(74) *Attorney, Agent, or Firm* — Oblon, McClelland, Maier & Neustadt, L.L.P.

(57) ABSTRACT

A hoisting type continuous casting device includes a keeping furnace, a first shape regulating member, an imaging section, an image analysis section, and a casting control section. The keeping furnace keeps a melt. The first shape regulating member is mounted in the vicinity of a molten surface of the melt kept in the keeping furnace and regulates a cross-
(Continued)

sectional shape of a casting to be casted by the melt passing therethrough. The imaging section captures an image of the melt that has passed through the first shape regulating member. The image analysis section detects swinging motion in the melt from the image and determines a solidification interface based on presence or absence of the swinging motion. The casting control section changes a casting condition when the solidification interface determined by the image analysis section is not within a predetermined reference range.

20 Claims, 14 Drawing Sheets

(51) Int. Cl.

| | |
|---|---|
| ***B22D 11/22*** | (2006.01) |
| ***B22D 11/124*** | (2006.01) |
| ***B22D 11/20*** | (2006.01) |
| ***B22D 41/00*** | (2006.01) |
| ***B22D 46/00*** | (2006.01) |

(52) U.S. Cl.
CPC ..... *B22D 11/22* (2013.01); *B22D 41/00* (2013.01); *B22D 46/00* (2013.01)

(56) References Cited

U.S. PATENT DOCUMENTS

| | | | | |
|---|---|---|---|---|
| 6,217,803 | B1 * | 4/2001 | Uozumi | B22D 11/04 164/418 |
| 2009/0064923 | A1 | 3/2009 | Takanashi | |
| 2013/0171021 | A1 | 7/2013 | Yaokawa et al. | |
| 2015/0071817 | A1 | 3/2015 | Sasaki et al. | |
| 2015/0298205 | A1 | 10/2015 | Sugiura | |

FOREIGN PATENT DOCUMENTS

| | | | |
|---|---|---|---|
| DE | 197 38 466 | C1 | 12/1998 |
| EP | 0 387 006 | A2 | 9/1990 |
| JP | 62-57418 | B2 | 12/1987 |
| JP | 63-30149 | A | 2/1988 |
| JP | 63-199050 | A | 8/1988 |
| JP | 9-248657 | A | 9/1997 |
| JP | 2012-61518 | A | 3/2012 |
| JP | 2013-193098 | A | 9/2013 |
| JP | 2014-104467 | A | 6/2014 |
| WO | WO 2012/035752 | A1 | 3/2012 |
| WO | WO 2013/136785 | A1 | 9/2013 |

OTHER PUBLICATIONS

Office Action dated Dec. 15, 2015 in Japanese Patent Application No. 2012-256512 (submitting Partial English translation only).

Notice of Allowance dated Jun. 30, 2017 in U.S. Appl. No. 15/036,977, filed May 16, 2016.

Office Action dated Jan. 20, 2017 in co-pending U.S. Appl. No. 15/036,977.

* cited by examiner

HOISTING TYPE CONTINUOUS CASTING DEVICE, HOISTING TYPE CONTINUOUS CASTING METHOD, AND SOLIDIFICATION INTERFACE DETECTION DEVICE

TECHNICAL FIELD

The invention relates to a hoisting type continuous casting device, a hoisting type continuous casting method, and a solidification interface detection device.

BACKGROUND ART

Patent Literature 1 suggests a free casting method as an innovative hoisting type continuous casting method that does not require a casting mold. As described in Patent Literature 1, after a starter is immersed in a surface of molten metal (a melt) (i.e., a molten surface), said starter is hoisted. At this time, due to a surface film and surface tension of the melt, the melt is also derived following the starter. Here, the melt is derived via a shape regulating member that is mounted in the vicinity of the molten surface and then cooled. Accordingly, a casting having a desired cross-sectional shape can continuously be casted.

In a normal continuous casting method, a longitudinal shape as well as a cross-sectional shape is regulated by the casting mold. In particular, in continuous casting method, since solidification metal (i.e., the casting) needs to pass through the casting mold, a casted article has a shape that linearly extends in a longitudinal direction.

On the contrary, the shape regulating member in the free casting method only regulates the cross-sectional shape of the casting and does not regulate the longitudinal shape thereof. In addition, since the shape regulating member can move in a parallel direction with the molten surface (i.e., a horizontal direction), castings with various longitudinal shapes can be obtained. For example, Patent Literature 1 discloses a hollow casting (i.e., a pipe) that is not formed in a linear shape in the longitudinal direction but in a zigzag shape or a helical shape.

RELATED ART LITERATURE

Patent Literature

Patent Literature 1: Japanese Patent Application Publication No. 2012-61518 (JP 2012-61518 A)

SUMMARY OF THE INVENTION

Problem to be Solved by the Invention

The inventor has found the following problem.

In the free casting method described in Patent Literature 1, since the melt that has been derived is cooled by cooling gas via the shape regulating member, a solidification interface is located on an upper side of the shape regulating member. A position of this solidification interface has a direct influence on dimensional accuracy and surface quality of the casting. Thus, it is important to detect the solidification interface and control the solidification interface within a specified range. However, it is difficult to detect the solidification interface.

The invention has been made in view of the above and therefore has a purpose of providing a hoisting type continuous casting method that can control a solidification interface within a specified range and realize superior dimensional accuracy and surface quality of a casting.

Means for Solving the Invention

A hoisting type continuous casting device according to one aspect of the invention includes:

a keeping furnace for keeping a melt;

a first shape regulating member mounted in the vicinity of a molten surface of the melt that is kept in the keeping furnace and regulating a cross-sectional shape of a casting to be casted when the melt passes therethrough;

an imaging section for capturing an image of the melt that has passed through the first shape regulating member;

an image analysis section for detecting swinging motion in the melt from the image and determining a solidification interface on the basis of presence or absence of the swinging motion; and a casting control section for changing a casting condition when the solidification interface determined by the image analysis section is not within a predetermined reference range. With such a configuration, it is possible to control the solidification interface within a specified range, and thus it is possible to improve dimensional accuracy and surface quality of the casting.

The casting condition is preferably any of a flow rate of cooling gas for cooling the melt that has passed through the first shape regulating member, a hoisting speed of the casting, and a setting temperature of the keeping furnace.

In addition, the first shape regulating member is preferably constructed of a pipe and either heats or cools the melt. Here, a heating element is preferably loaded in the pipe and heats the melt. Alternatively, the cooling gas preferably flows through the pipe and cools the melt. In this way, it is possible to promptly change a temperature of the melt that passes through the first shape regulating member.

A second shape regulating member is further preferably provided in the vicinity and a lower side of the solidification interface. Here, the second shape regulating member is preferably driven in an up-down direction in accordance with a position of the solidification interface. In this way, it is possible to further improve the dimensional accuracy and the surface quality of the casting.

The first shape regulating member is preferably divided into plural elements. The image analysis section preferably detects a dimension of the casting from the image. The casting control section preferably changes the cross-sectional shape that is regulated by the first shape regulating member on the basis of the dimension of the casting. In this way, it is possible to improve the dimensional accuracy of the casting.

A hoisting type continuous casting device according to one aspect of the invention includes:

a keeping furnace for keeping a melt;

a shape regulating member mounted in the vicinity of a molten surface of the melt that is kept in the keeping furnace and regulating a cross-sectional shape of a casting to be casted when the melt passes therethrough; and a cooling section for cooling the melt that has passed through the shape regulating member, in which the shape regulating member includes heating means or cooling means therein. In this way, it is possible to promptly change a temperature of the melt that has passed through the shape regulating member.

A hoisting type continuous casting device according to one aspect of the invention includes:

a keeping furnace for keeping a melt;

a first shape regulating member mounted in the vicinity of a molten surface of the melt that is kept in the keeping furnace and regulating a cross-sectional shape of a casting to be casted when the melt passes therethrough; and a second shape regulating member provided in the vicinity and a lower side of a solidification interface of the melt that has passed through the first shape regulating member. In this way, it is possible to improve the dimensional accuracy and the surface quality of the casting.

A hoisting type continuous casting method according to one aspect of the invention includes the steps of:

allowing a melt that is kept in a keeping furnace to pass through a first shape regulating member for regulating a cross-sectional shape of a casting to be casted and hoisting the melt;

capturing an image of the melt that has passed through the first shape regulating member;

detecting swinging motion in the melt from the image and determining a solidification interface on the basis of presence or absence of the swinging motion; and changing a casting condition when the determined solidification interface is not within a predetermined reference range. With such a configuration, it is possible to control the solidification interface within a specified range, and thus it is possible to improve the dimensional accuracy and the surface quality of the casting.

The casting condition is preferably any of a flow rate of cooling gas for cooling the melt that has passed through the first shape regulating member, a hoisting speed of the casting, and a setting temperature of the keeping furnace.

In addition, the first shape regulating member is preferably constructed of a pipe, and the melt is preferably either heated or cooled by the first shape regulating member. Here, a heating element is preferably loaded in the pipe and heats the melt. Alternatively, the cooling gas preferably flows through the pipe and cools the melt. In this way, it is possible to promptly change a temperature of the melt that passes through the first shape regulating member.

The melt that has passed through the first shape regulating member preferably passes through a second shape regulating member provided in the vicinity and a lower side of the solidification interface. Here, the second shape regulating member is preferably driven in an up-down direction in accordance with a position of the solidification interface. In this way, it is possible to further improve the dimensional accuracy and the surface quality of the casting.

The first shape regulating member is preferably configured to be divided into plural elements. A dimension of the casting is preferably detected from the image. The cross-sectional shape that is regulated by the first shape regulating member is preferably changed on the basis of the dimension of the casting. In this way, it is possible to improve the dimensional accuracy of the casting.

A hoisting type continuous casting method according to one aspect of the invention includes the steps of:

allowing a melt that is kept in a keeping furnace to pass through a shape regulating member for regulating a cross-sectional shape of a casting to be casted and hoisting the melt; and cooling the melt that has passed through the shape regulating member and has been hoisted, in which the shape regulating member is provided with heating means or cooling means therein. In this way, it is possible to promptly change a temperature of the melt that passes through the shape regulating member.

A hoisting type continuous casting method according to one aspect of the invention includes the steps of:

allowing a melt that is kept in a keeping furnace to pass through a first shape regulating member for regulating a cross-sectional shape of a casting to be casted and hoisting the melt; and allowing the melt that has passed through the first shape regulating member to pass through a second shape regulating member provided in the vicinity and a lower side of a solidification interface of said melt. In this way, it is possible to improve the dimensional accuracy and the surface quality of the casting.

A solidification interface detection device according to one aspect of the invention is a solidification interface detection device for detecting a solidification interface of a melt that has passed through a shape regulating member for regulating a cross-sectional shape of a casting to be casted, and includes:

an imaging section for capturing an image of the melt that has passed through the shape regulating member; and an image analysis section for detecting swinging motion in the melt from the image and determining the solidification interface on the basis of presence or absence of the swinging motion.

Effect of the Invention

It is possible with the invention to control the solidification interface within the specified range, and it is thus possible to provide the hoisting type continuous casting method that can realize the superior dimensional accuracy and surface quality of the casting.

MODES FOR CARRYING OUT THE INVENTION

A detailed description will hereinafter be made on specific embodiments to which the invention is applied with reference to the drawings. However, the invention is not limited to the embodiments below. In addition, for clarification of the description, the following description and the drawings are appropriately simplified.

First Embodiment

Figure 1:
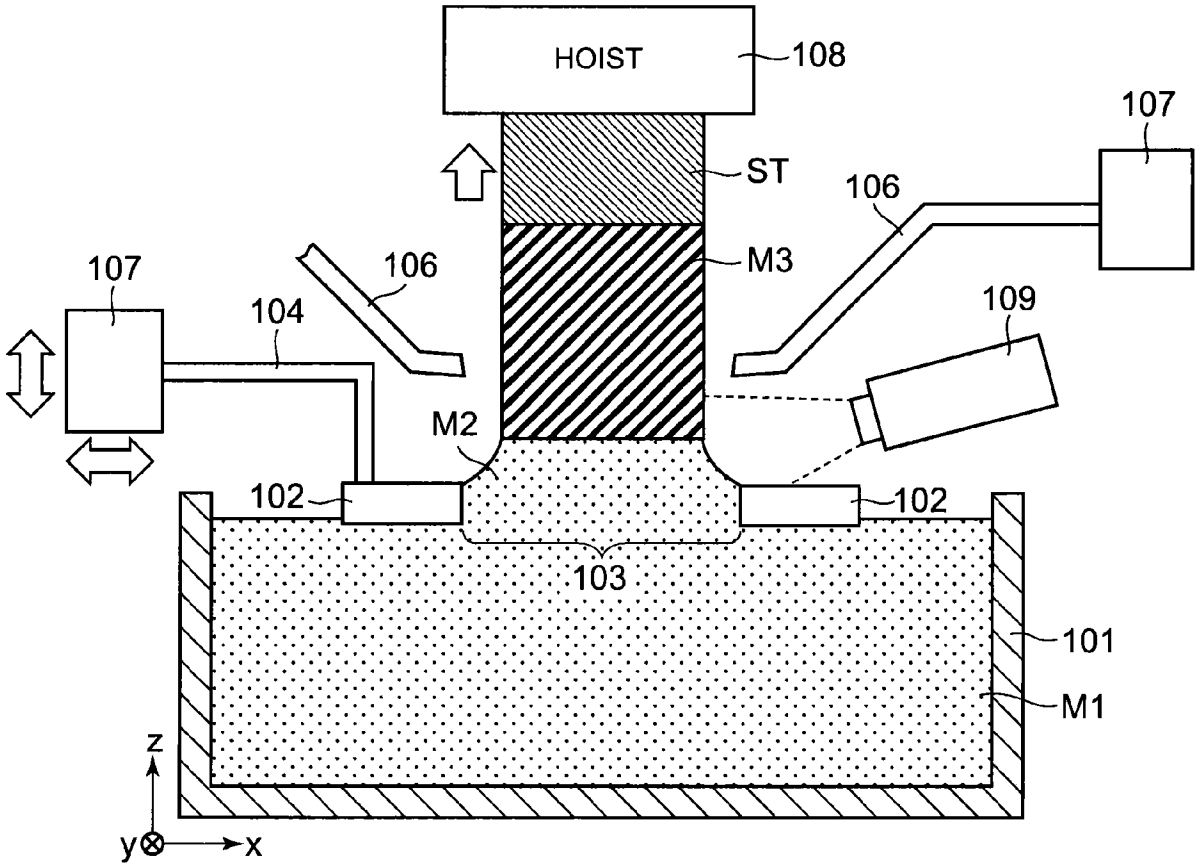
FIG. 1 is a schematic cross-sectional view of a free casting device according to a first embodiment.

First, a description will be made on a free casting device (a hoisting type continuous casting device) according to a first embodiment with reference to FIG. 1. FIG. 1 is a schematic cross-sectional view of the free casting device according to the first embodiment. As shown in FIG. 1, the free casting device according to the first embodiment includes a melt keeping furnace 101, a shape regulating member 102, a support rod 104, an actuator 105, a cooling gas nozzle 106, a cooling gas supply section 107, a hoist 108, and an imaging section (a camera) 109. An x-y plane in FIG. 1 constitutes a horizontal surface, and a z-axis direction is a vertical direction. More specifically, a plus direction of the z-axis is vertically upward.

The melt keeping furnace 101 accommodates a melt M1, such as aluminum or alloy thereof, and keeps the melt M1 at a specified temperature. In an example of FIG. 1, since the melt is not refilled in the melt keeping furnace 101 during casting, a surface of the melt M1 (i.e., a molten surface) is lowered along with progress in the casting. On the other hand, such a configuration that the melt is constantly refilled in the melt keeping furnace 101 during the casting so as to keep the molten surface constant may be adopted. Here, when a setting temperature of the keeping furnace is increased, a position of a solidification interface can be ascended. On the contrary, when the setting temperature of the keeping furnace is lowered, the position of the solidification interface can be descended. Needless to say, the melt M1 may be another type of metal or alloy other than aluminum.

The shape regulating member 102 is made of ceramics, stainless steel, or the like, for example, and arranged in the vicinity of the molten surface. In the example of FIG. 1, the shape regulating member 102 is arranged in contact with the molten surface. The shape regulating member 102 regulates a cross-sectional shape of a casting M3 to be casted and prevents invasion of an oxide film formed on the surface of the melt M1 or a foreign matter floating on the surface of the melt M1 into the casting M3. The casting M3 shown in FIG. 1 is a solid casting that has a plate-shaped horizontal cross section (hereinafter referred to as a transverse section).

Figure 2:
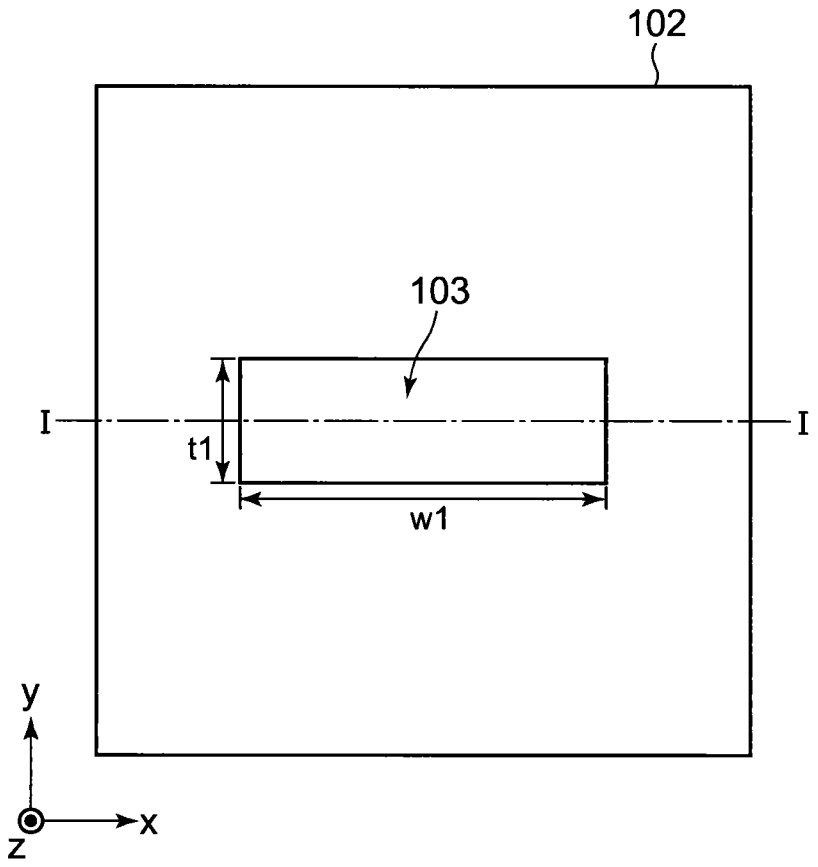
FIG. 2 is a plan view of a shape regulating member 102 according to the first embodiment.

FIG. 2 is a plan view of the shape regulating member 102 according to the first embodiment. Here, a cross-sectional view of the shape regulating member 102 in FIG. 1 corresponds to a cross-sectional view that is taken along I-I in FIG. 2. As shown in FIG. 2, the shape regulating member 102 has a rectangular planar shape, for example, and has a rectangular opening (a melt passing section 103) in a thickness t1×a width w1, through which the melt passes through, at a central section. It should be noted that xyz coordinates in FIG. 2 corresponds to those in FIG. 1.

As shown in FIG. 1, due to a surface film and surface tension, the melt M1 is hoisted by following the casting M3 and passes through the melt passing section 103 of the shape regulating member 102. In other words, since the melt M1 passes through the melt passing section 103 of the shape regulating member 102, an external force is applied from the shape regulating member 102 to the melt M1, and thus the cross-sectional shape of the casting M3 is regulated. Here, the melt that has been hoisted from the molten metal by following the casting M3 due to the surface film and the surface tension of the melt is referred to as a kept melt M2. In addition, a boundary between the casting M3 and the kept melt M2 is the solidification interface.

The support rod 104 supports the shape regulating member 102.

The support rod 104 is coupled to the actuator 105. The actuator 105 allows movement of the shape regulating member 102 in an up-down direction (the vertical direction) and the horizontal direction via the support rod 104. With such a configuration, the shape regulating member 102 can move downward along with lowering of the molten surface due to the progress in the casting. In addition, since the shape regulating member 102 can move in the horizontal direction, a longitudinal shape of the casting M3 can freely be changed.

The cooling gas nozzle (a cooling section) 106 is cooling means for blowing cooling gas (air, nitrogen, argon, or the like) supplied from the cooling gas supply section 107 onto the casting M3 for cooling. When the flow rate of the cooling gas is increased, the position of the solidification interface can be descended. On the other hand, when the flow rate of the cooling gas is reduced, the position of the solidification interface can be ascended.

While the casting M3 is hoisted by the hoist 108 that is coupled to a starter ST, the casting M3 is cooled by the cooling gas. In this way, the kept melt M2 in the vicinity of the solidification interface is sequentially solidification, thereby forming the casting M3. When a hoisting speed by the hoist 108 is increased, the position of the solidification interface can be ascended. On the other hand, when the hoisting speed is reduced, the position of the solidification interface can be descended.

The imaging section 109 continuously monitors the vicinity of the solidification interface, which is the boundary between the casting M3 and the kept melt M2, during the casting. As will be described in detail below, the solidification interface can be determined by an image captured by the imaging section 109.

Figure 3:
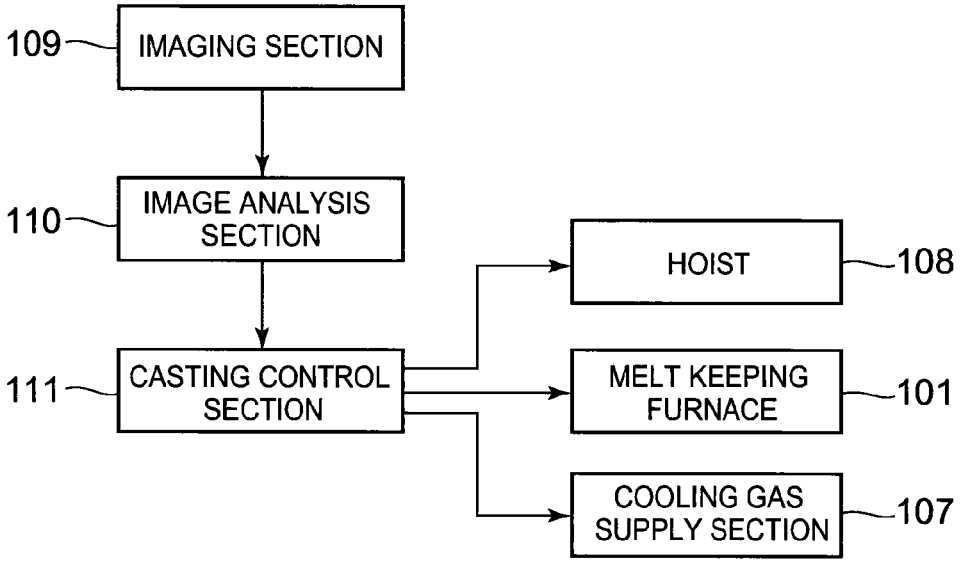
FIG. 3 is a block diagram of a solidification interface control system provided in the free casting device according to the first embodiment.

Next, a description will be made on a solidification interface control system provided in the free casting device according to the first embodiment with reference to FIG. 3. FIG. 3 is a block diagram of the solidification interface control system provided in the free casting device according to the first embodiment. Said solidification interface control system keeps the position (a height) of the solidification interface within a specified reference range.

As shown in FIG. 3, this solidification interface control system includes the imaging section 109, an image analysis section 110, a casting control section 111, the hoist 108, the melt keeping furnace 101, and the cooling gas supply section 107. Here, since the imaging section 109, the hoist 108, the melt keeping furnace 101, and the cooling gas supply section 107 have been described with reference to FIG. 1, the detailed description thereon will not be made.

The image analysis section 110 detects swinging motion in a surface of the kept melt M2 from an image captured by the imaging section 109. More specifically, the swinging motion in the surface of the kept melt M2 can be detected by comparing the plural images that are continuously captured. Meanwhile, the swinging motion is not generated in a surface of the casting M3. Thus, the solidification interface can be determined on the basis of presence or absence of the swinging motion.

The imaging section 109 and the image analysis section 110 constitute a solidification interface detection device.

Here, it is considered that the solidification interface can also be determined by measuring a temperature of the melt in the vicinity of the solidification interface. However, due to a concern of a negative influence on the shape of the casting, a contact measurement such as by a thermocouple is difficult. In addition, in the case where the melt is aluminum or the alloy thereof, the oxide film is formed on the surface of the melt. Thus, non-contact measurement such as by a radiation thermometer is also difficult.

Figure 4:
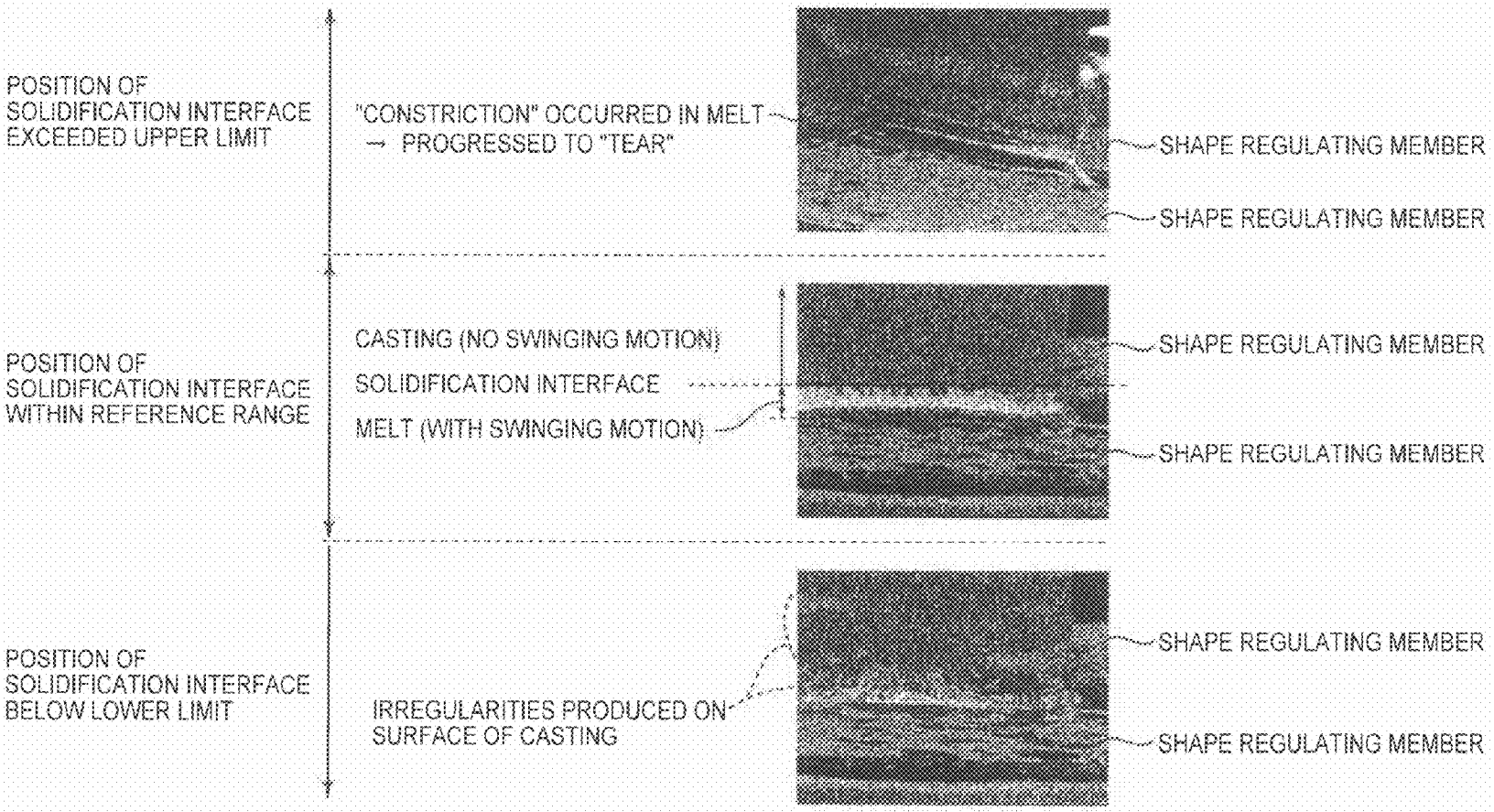
FIG. 4 includes three image examples in the vicinity of a solidification interface.

Here, a further specific description will be made with reference to FIG. 4. FIG. 4 includes three image examples in the vicinity of the solidification interface. In an order from the top of FIG. 4, an image example in the case where the position of the solidification interface exceeds an upper limit, an image example in the case where the position of the solidification interface is within the reference range, and an image example in the case where the position of the solidification interface is below an lower limit are shown. As shown in the middle image example of FIG. 4, the image analysis section 110 determines a boundary section between a region where the swinging motion is detected (i.e., that is considered the melt) and a region where the swinging motion is not detected (i.e., that is considered the casting) as the solidification interface in the image captured by the imaging section 109, for example.

The casting control section 111 includes a storage section (not shown) for storing the reference range (the upper limit and the lower limit) of the position of the solidification interface. Then, when the solidification interface determined by the image analysis section 110 exceeds the upper limit, the casting control section 111 reduces the hoisting speed of the hoist 108, lowers the setting temperature of the melt keeping furnace 101, or increases the flow rate of the cooling gas supplied from the cooling gas supply section 107. On the other hand, when the solidification interface determined by the image analysis section 110 is below the lower limit, the casting control section 111 increases the hoisting speed of the hoist 108, increases the setting temperature of the melt keeping furnace 101, or reduces the flow rate of the cooling gas supplied from the cooling gas supply section 107. In the control using these three conditions, two or more of the conditions may be changed simultaneously. However, changing only one of the conditions is preferred in terms of ease of the control. Alternatively, the three conditions may be prioritized in advance, and the conditions may be changed in a descending of the priority.

A description will be made on the upper limit and the lower limit of the position of the solidification interface with reference to FIG. 4. As shown in the image example at the top of FIG. 4, when the position of the solidification interface exceeds the upper limit, "constriction" occurs in the kept melt M2, which is progressed to a "tear". The upper limit of the position of the solidification interface can be determined by changing the height of the solidification interface and investigating in advance whether the "constriction" occurs in the kept melt M2. On the other hand, as shown in the image example at the bottom of FIG. 4, when the position of the solidification interface is below the lower limit, irregularities are produced on the surface of the casting M3, which results in shape defect. The lower limit of the position of the solidification interface can be determined by changing the height of the solidification interface and investigating in advance whether the irregularities are produced on the surface of the casting M3.

The upper limit of the solidification interface can also be determined by calculation.

Figure 5:
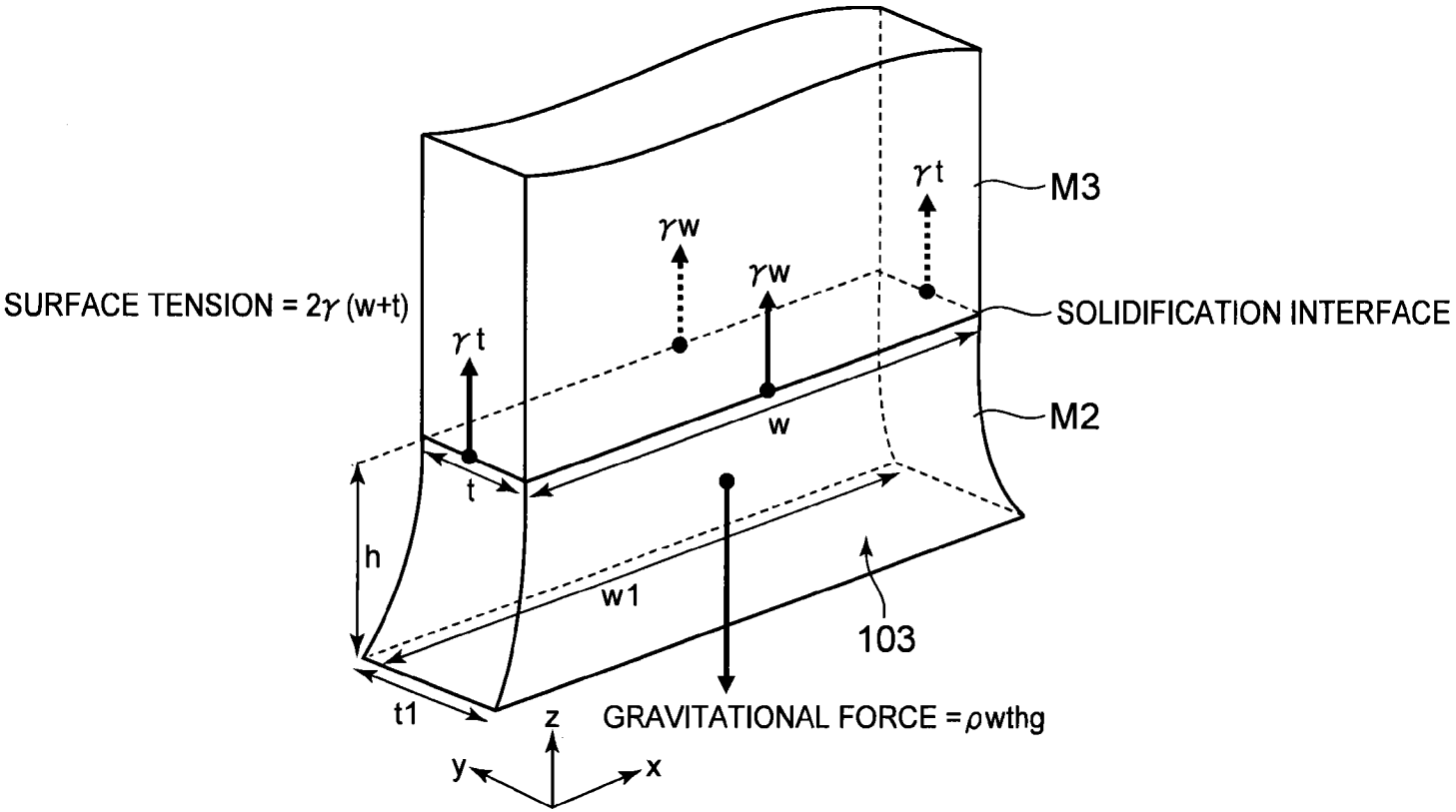
FIG. 5 is a view of balance between surface tension in the solidification interface and a gravitational force of a kept melt.

FIG. 5 is a view of balance between the surface tension in the solidification interface and a gravitational force of the kept melt. As shown in FIG. 5, the surface tension for keeping the kept melt M2 can be expressed as $2\gamma\ (w+t)$ by using a thickness t, a width w, and surface tension $\gamma$ per unit length of the casing M3 in the solidification interface. Meanwhile, the gravitational force on the kept melt M2 can approximate $\rho wthg$ by using density of the melt $\rho$, a height h from the surface of the melt (the molten surface) of the solidification interface, and gravitational acceleration g. Here, since the surface tension for keeping the kept melt M2 needs to be larger than the gravitational force on the kept melt M2, $2\gamma\ (w+t)>\rho wthg$ is established. For example, the upper limit may be determined from the height h of the solidification interface that satisfies this relational expression. It should be noted that, since the kept melt M2 broadens toward the bottom as shown in FIG. 5, the thickness t and the width w of the casting M3 are respectively smaller values than the thickness t1 and the width w1 of the melt passing section 103. In addition, xyz coordinates in FIG. 5 correspond to those in FIG. 1.

The free casting device according to the first embodiment includes: the imaging section for capturing an image of the vicinity of the solidification interface; the image analysis section for detecting the swinging motion in the surface of the melt from the image and thereby determining the solidification interface; and the casting control section for changing the casting condition(s) when the solidification interface is not within the reference range. Accordingly, it is possible to detect the solidification interface and thus to execute feedback control for maintaining the solidification interface within the specified reference range. Therefore, it is possible to improve dimensional accuracy and surface quality of the casting.

Next, a description will be made on a free casting method according to the first embodiment with reference to FIG. 1.

First, the starter ST is descended, and a tip of the starter ST is immersed into the melt M1 through the melt passing section 103 of the shape regulating member 102.

Next, hoisting of the starter ST is started at a specified speed. Here, even when the starter ST is separated from the molten surface, the kept melt M2 that is hoisted from the molten surface by following the starter ST is formed due to the surface film and the surface tension. As shown in FIG. 1, the kept melt M2 is formed in the melt passing section 103 of the shape regulating member 102. In other words, the shape regulating member 102 applies a shape to the kept melt M2.

Next, since the starter ST is cooled by the cooling gas, which is blown out of the cooling gas nozzle 106, the kept melt M2 is sequentially solidification from an upper side to a lower side, and the casting M3 thereby grows. In this way, the casting M3 can continuously be casted. In the free casting method according to the first embodiment, it is controlled such that the solidification interface is kept within the specified reference range. A description will hereinafter be made on a solidification interface control method with reference to FIG. 6.

Figure 6:
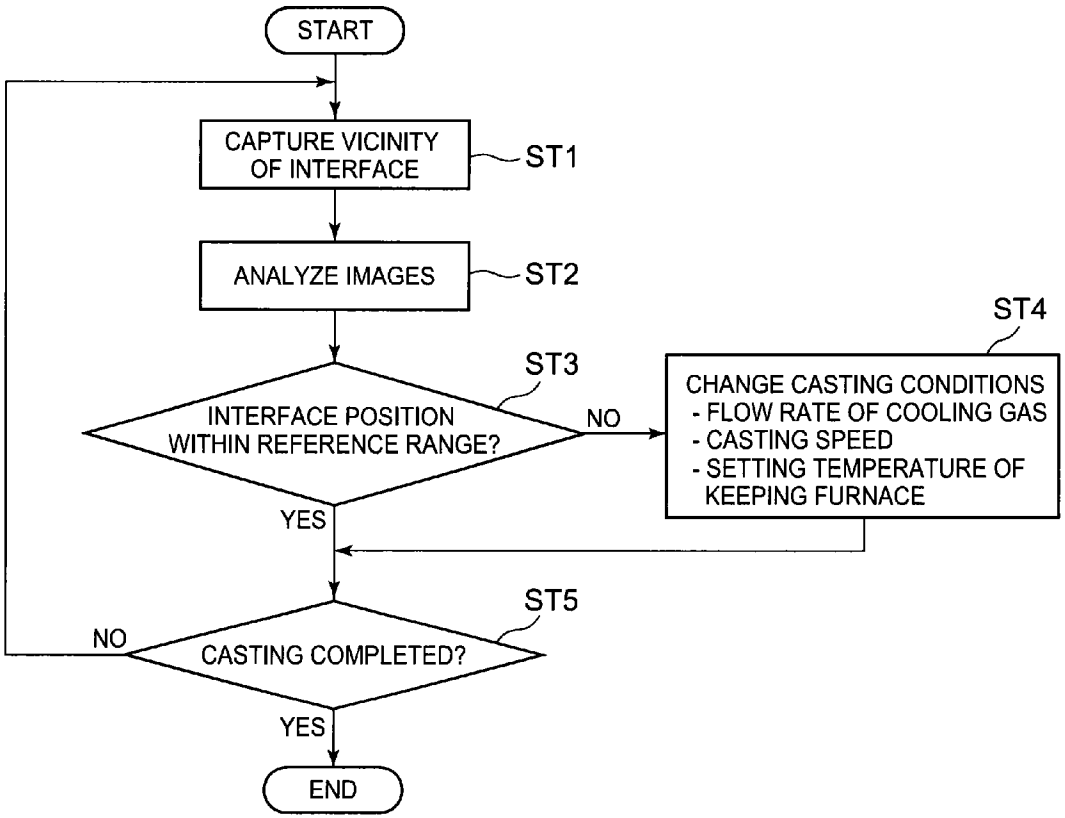
FIG. 6 is a flowchart for illustrating a solidification interface control method according to the first embodiment.

FIG. 6 is a flowchart for illustrating the solidification interface control method according to the first embodiment.

First, the imaging section 109 captures the image of the vicinity of the solidification interface (step ST1).

Next, the image analysis section 110 analyzes the image captured by the imaging section 109 (step ST2). More specifically, the image analysis section 110 detects the swinging motion in the surface of the kept melt M2 by comparing the plural images that are continuously captured. Then, the image analysis section 110 determines the boundary section between the region where the swinging motion is detected and the region where the swinging motion is not detected as the solidification interface in the images captured by the imaging section 109.

Next, the casting control section 111 determines whether the position of the solidification interface determined by the image analysis section 110 is within the reference range (step ST3). If the position of the solidification interface is not within the reference range (step ST3: NO), the casting control section 111 changes any of the conditions of the flow rate of the cooling gas, a casting speed, and the setting temperature of the keeping furnace (step ST4). Thereafter, the casting control section 111 determines whether the casting has been completed (step ST5).

More specifically, in step ST4, when the solidification interface determined by the image analysis section 110 exceeds the upper limit, the casting control section 111 reduces the hoisting speed of the hoist 108, lowers the setting temperature of the melt keeping furnace 101, or increases the flow rate of the cooling gas supplied from the cooling gas supply section 107. On the other hand, when the solidification interface determined by the image analysis section 110 is below the lower limit, the casting control section 111 increases the hoisting speed of the hoist 108, increases the setting temperature of the melt keeping furnace 101, or reduces the flow rate of the cooling gas supplied from the cooling gas supply section 107.

If the position of the solidification interface is within the reference range (step ST3: YES), the casting conditions are not changed, and the process proceeds to step ST5.

If the casting has not been completed (step ST5: NO), the process returns to step ST1. On the other hand, if the casting has been completed (step ST5: YES), the control of the solidification interface is terminated.

In the free casting method according to the first embodiment, the images of the vicinity of the solidification interface are captured, the swinging motion in the surface of the melt is detected from the images, and the solidification interface is thereby determined. If the solidification interface is not within the reference range, the casting condition(s) is changed. In other words, the feedback control for maintaining the solidification interface within the specified reference range can be executed. Therefore, it is possible to improve the dimensional accuracy and the surface quality of the casting.

Second Embodiment

Figure 7:
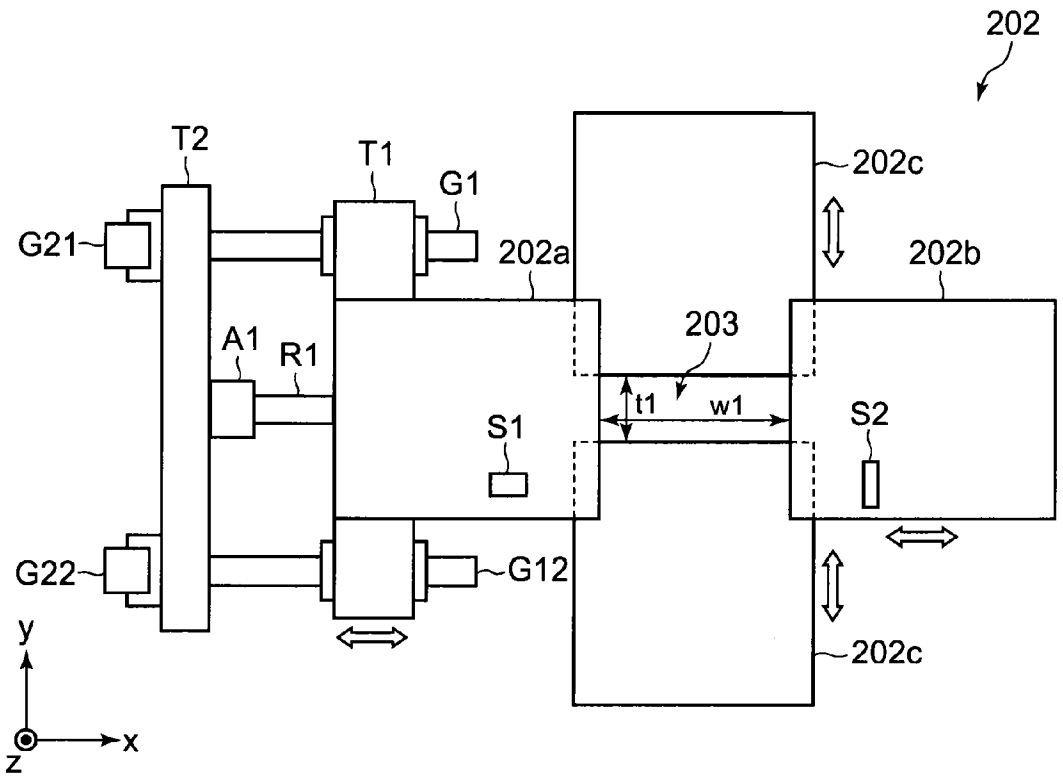
FIG. 7 is a plan view of a shape regulating member 202 according to a second embodiment.
Figure 8:
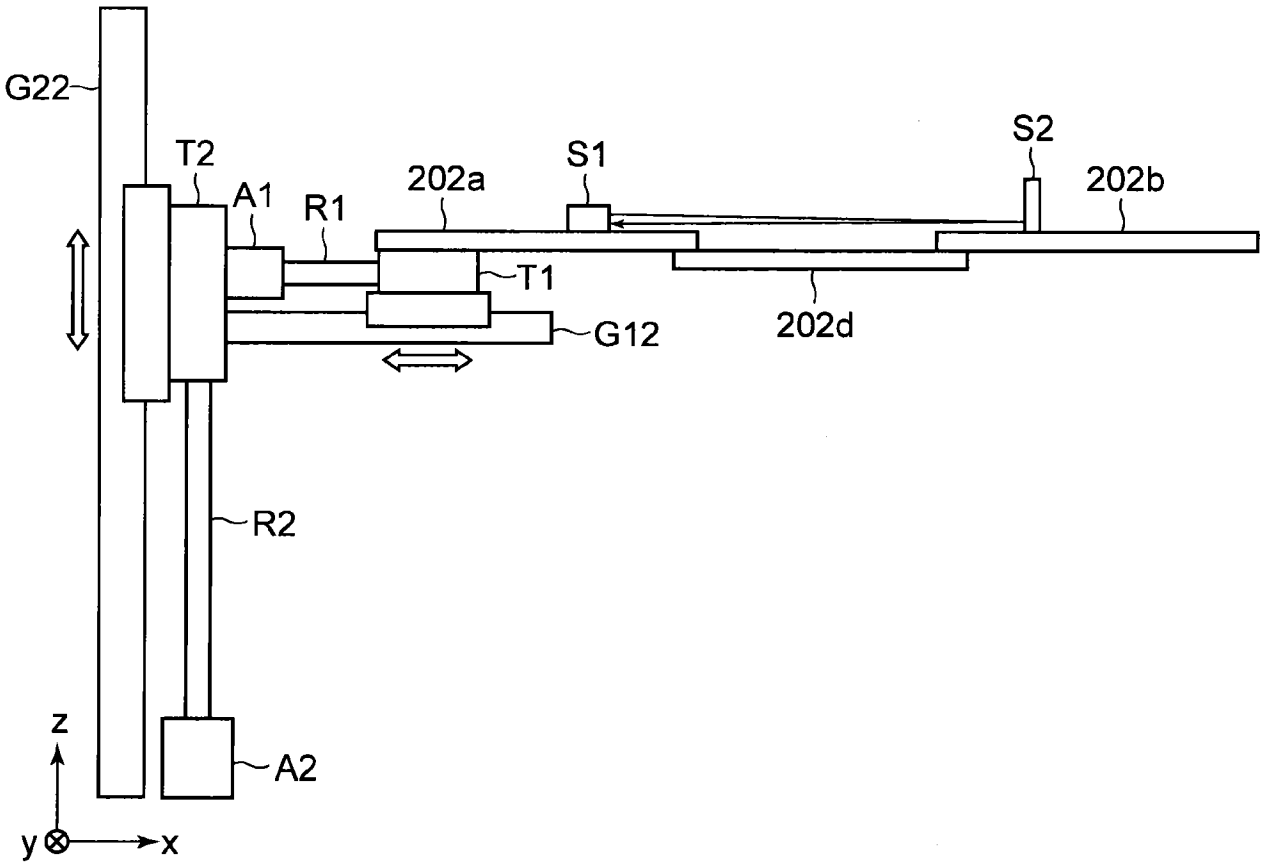
FIG. 8 is a side view of the shape regulating member 202 according to the second embodiment.

Next, a description will be made on a free casting device according to a second embodiment with reference to FIGS. 7, 8. FIG. 7 is a plan view of a shape regulating member 202 according to the second embodiment. FIG. 8 is a side view of the shape regulating member 202 according to the second embodiment. It should be noted that xyz coordinates in FIGS. 7, 8 also correspond to those in FIG. 1.

The shape regulating member 102 according to the first embodiment, which is shown in FIG. 2, is formed of one plate. Thus, the thickness t1 and the width w1 of the melt passing section 103 are fixed. Meanwhile, as shown in FIG. 7, the shape regulating member 202 according to the second embodiment includes four rectangular shape regulating plates 202*a*, 202*b*, 202*c*, 202*d*. In other words, the shape regulating member 202 according to the second embodiment is divided into plural elements. With such a configuration, a thickness t1 and a width w1 of a melt passing section 203 can be changed. In addition, the four rectangular shape regulating plates 202*a*, 202*b*, 202*c*, 202*d* can synchronously move in the z-axis direction.

As shown in FIG. 7, the shape regulating plates 202*a*, 202*b* are aligned in an x-axis direction to face each other. In addition, as shown in FIG. 8, the shape regulating plates 202*a*, 202*b* are arranged at the same height in the z-axis direction. A space between the shape regulating plates 202*a*, 202*b* regulates the width w1 of the melt passing section 203. Then, since the shape regulating plates 202*a*, 202*b* can independently move in the x-axis direction, the width w1 can be changed. It should be noted that, as shown in FIGS. 7, 8, a laser displacement gauge S1 and a laser reflection plate S2 may respectively be provided on the shape regulating plate 202*a* and the shape regulating plate 202*b* in order to measure the width w1 of the melt passing section 203.

In addition, as shown in FIG. 7, the shape regulating plates 202*c*, 202*d* are aligned in a y-axis direction to face each other. Furthermore, the shape regulating plates 202*c*, 202*c* are arranged at the same height in the z-axis direction. A space between the shape regulating plates 202*c*, 202*d* regulates the thickness t1 of the melt passing section 203. Then, since the shape regulating plates 202*c*, 202*d* can independently move in the y-axis direction, the thickness t1 can be changed.

The shape regulating plates 202*a*, 202*b* are arranged to respectively contact upper sides of the shape regulating plates 202*c*, 202*d*.

Next, a description will be made on a drive mechanism of the shape regulating plate 202*a* with reference to FIGS. 7, 8. As shown in FIGS. 7, 8, the drive mechanism of the shape regulating plate 202*a* includes slide tables T1, T2, linear guides G11, G12, G21, G22, actuators A1, A2, and rods R1, R2. It should be noted that each of the shape regulating plates 202*b*, 202*c*, 202*d* includes the drive mechanism like the shape regulating plate 202*a*; however, these are not shown in FIGS. 7, 8.

As shown in FIGS. 7, 8, the shape regulating plate 202*a* is mounted on and fixed to the slide table T1 that can slide in the x-axis direction. The slide table T1 is slidably mounted on a pair of the linear guides G11, G12 that extend in parallel in the x-axis direction. In addition, the slide table T1 is coupled to the rod R1 that extends from the actuator A1 in the x-axis direction. With a configuration as described above, the shape regulating plate 202*a* can slide in the x-axis direction.

In addition, as shown in FIGS. 7, 8, the linear guides G11, G12 and the actuator A1 are mounted and fixed to the slide table T2 that can slide in the z-axis direction. The slide table T2 is slidably mounted to a pair of the linear guides G21, G22 that extend in parallel in the z-axis direction. Furthermore, the slide table T2 is coupled to the rod R2 that extends from the actuator A2 in the z-axis direction. The linear guides G21, G22 and the actuator A2 are fixed to a horizontal floor surface (not shown), a seat (not shown), or the like. With a configuration as described above, the shape regulating plate 202*a* can slide in the z-axis direction. It should be noted that a hydraulic cylinder, an air cylinder, a motor, or the like can be raised as the actuators A1, A2.

Figure 9:
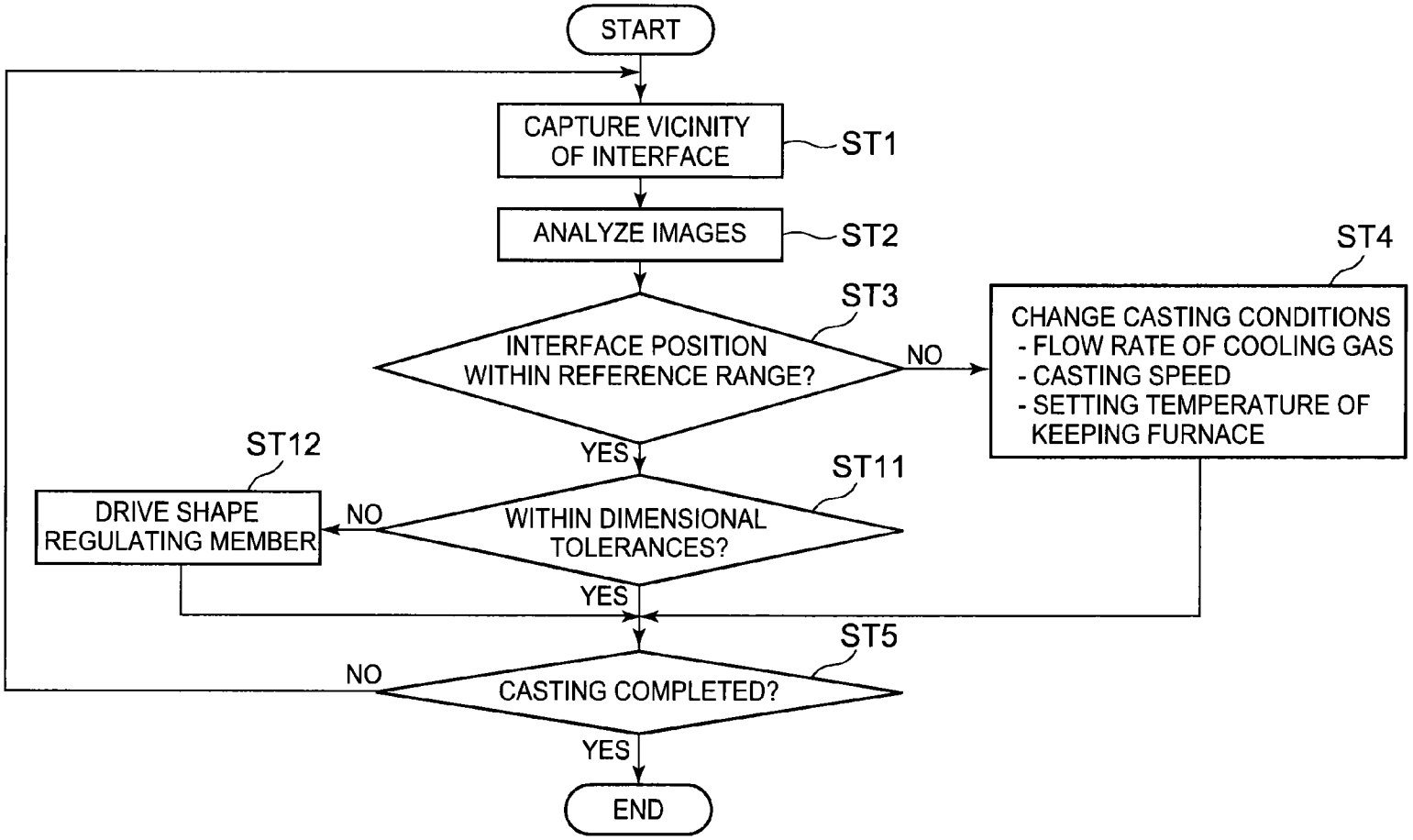
FIG. 9 is a flowchart for illustrating a solidification interface control method according to the second embodiment.

Next, a description will be made on a solidification interface control method according to the second embodiment with reference to FIG. 9. FIG. 9 is a flowchart for illustrating the solidification interface control method according to the second embodiment. In FIG. 9, a process up to step ST4 is the same as the process in the first embodiment, which is shown in FIG. 6. Thus, the detailed description thereon will not be made.

If the position of the solidification interface is within the reference range (step ST3: YES), the casting control section 111 determines whether dimensions (the thickness t and the width w) of the solidification interface determined by the image analysis section 110 are within dimensional tolerances of the casting M3 (step ST11). Here, the dimensions (the thickness t and the width w) of the solidification interface can be obtained at the same time as when the image analysis section 110 determines the solidification interface. If the dimensions obtained from the images are not within the dimensional tolerance (step ST11: NO), the thickness t1, the width w1, or both of the melt passing section 203 are changed (step ST12). Thereafter, the casting control section 111 determines whether the casting has been completed (step ST5).

If the dimensions are within the dimensional tolerances (step ST11: YES), neither the thickness t1 nor the width w1 of the melt passing section 203 is changed, and the process proceeds to step ST5.

If the casting has not been completed (step ST5: NO), the process returns to step ST1. On the other hand, if the casting has been completed (step ST5: YES), the control of the solidification interface is terminated.

Since the rest of the configuration is the same as that in the first embodiment, a description thereon will not be made.

In the free casting method according to the second embodiment, similar to the first embodiment, the images of the vicinity of the solidification interface are captured, the swinging motion in the surface of the melt is detected from the images, and the solidification interface is thereby determined. Then, if the solidification interface is not within the reference range, the casting condition(s) is changed. In other words, the feedback control for maintaining the solidification interface within the specified reference range can be executed. Therefore, it is possible to improve the dimensional accuracy and the surface quality of the casting. In addition, in the free casting method according to the second embodiment, the thickness t1 and the width w1 of the melt passing section 203 can be changed. Thus, when the solidification interface is determined from the images, the thickness t and the width w of said solidification interface are measured. Then, if at least one of these measured values is not within the dimensional tolerance, the thickness t1, the width w1, or both of the melt passing section 203 are changed. In other words, the feedback control for maintaining the dimensions of the casting within the dimensional tolerances can be executed. Therefore, it is possible to further improve the dimensional accuracy of the casting.

Third Embodiment

Figure 10:
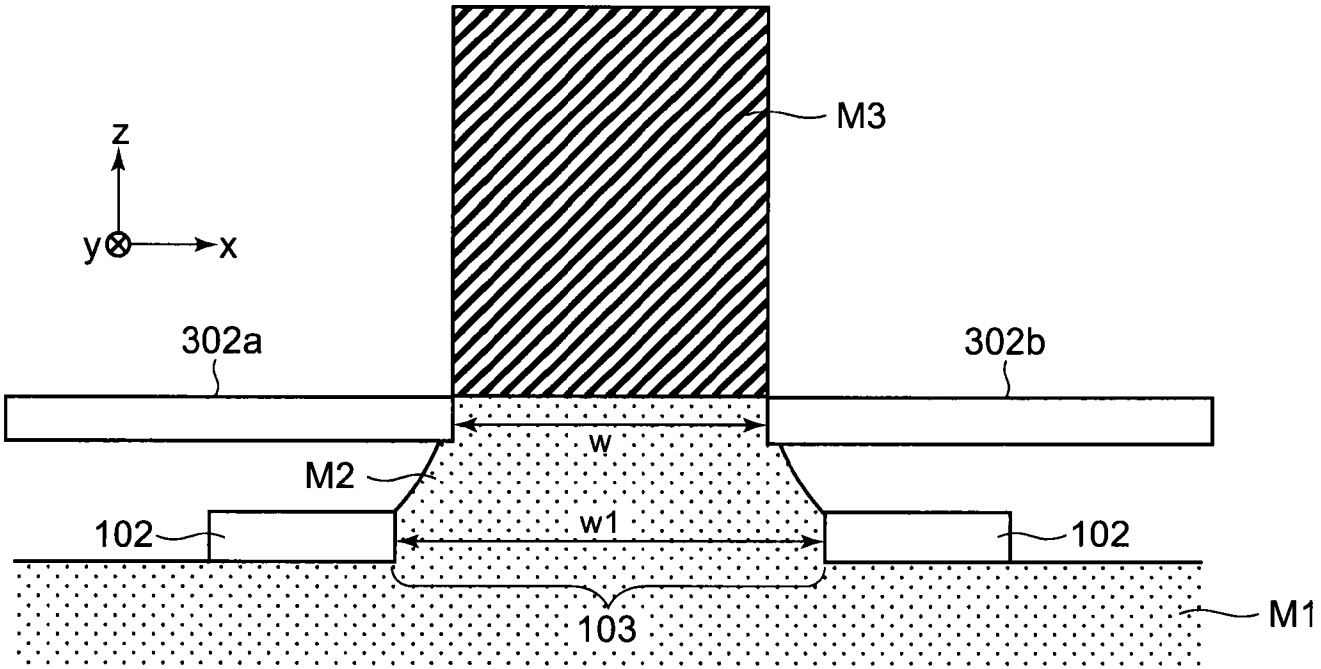
FIG. 10 is a schematic cross-sectional view of a free casting device according to a third embodiment.
Figure 11:
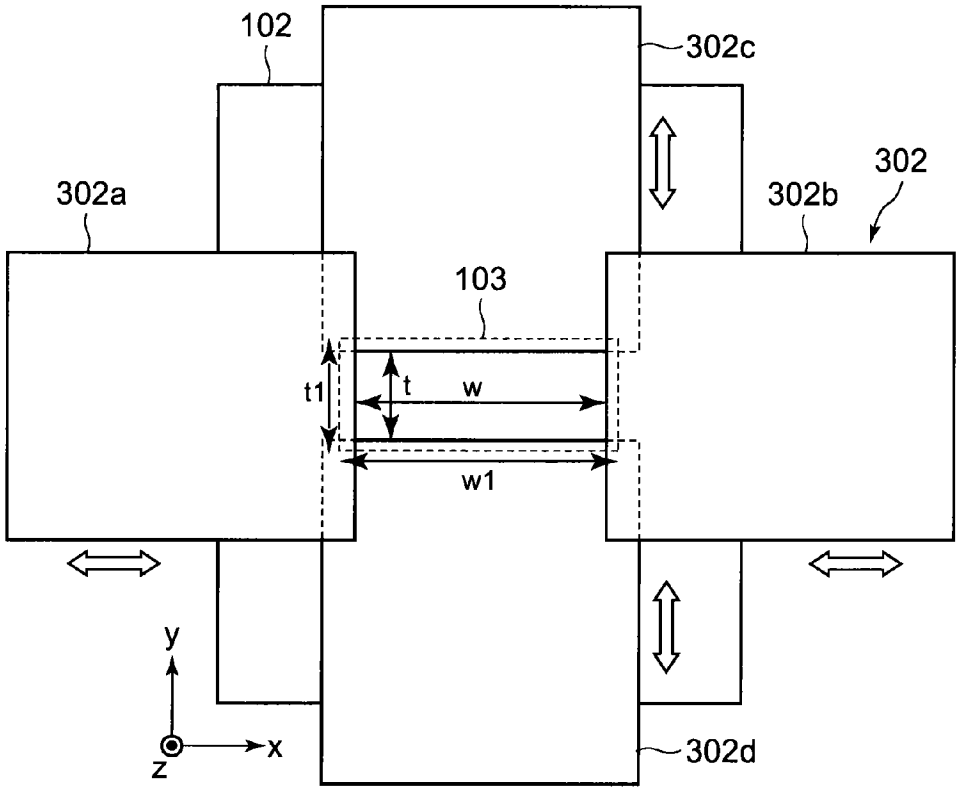
FIG. 11 is a plan view of a shape regulating member according to the third embodiment.

Next, a description will be made on a free casting device according to a third embodiment with reference to FIGS. 10, 11. FIG. 10 is a schematic cross-sectional view of the free casting device according to the third embodiment. FIG. 11 is a plan view of a shape regulating member according to the third embodiment. It should be noted that xyz coordinates in FIGS. 10, 11 also correspond to those in FIG. 1. In the free casting device according to the third embodiment, a first the shape regulating member 102 that is similar to the shape regulating member 102 according to the first embodiment is provided on the surface of the melt, and a second shape regulating member 302 that is similar to the shape regulating member 202 according to the second embodiment is provided immediately below the solidification interface.

It is preferred that the second shape regulating member 302 is constantly under the feedback control such that the second shape regulating member 302 is arranged immediately below the solidification interface (in the vicinity and a lower side of the solidification interface) that is determined by the image analysis. Here, similar to the shape regulating member 202 according to the second embodiment, the second shape regulating member 302 includes four rectangular shape regulating plates 302*a*, 302*b*, 302*c*, 302*d*. In addition, the four rectangular shape regulating plates 302*a*, 302*b*, 302*c*, 302*d* can synchronously move in the z-axis direction. Each of the four rectangular shape regulating plates 302*a*, 302*b*, 302*c*, 302*d* preferably has a thickness of 3 mm or less. It should be noted that the vicinity of the solidification interface means at least the solidification interface side from the center between the surface of the melt and the solidification interface.

Since the rest of the configuration is the same as that in the first embodiment, a detailed description thereon will not be made.

In the first and second embodiments, the desired casting dimensions (the thickness t and the width w) need to be obtained from the dimensions (the thickness t1 and the width w1) of the melt passing sections 103, 203. Thus, the control thereof is difficult. In the third embodiment, the thickness and the width of the kept melt M2 immediately below the solidification interface (i.e., the casting M3) can directly be regulated by the second shape regulating member 302. In other words, the thickness and the width of the kept melt M2 immediately below the solidification interface can correspond to the dimensions (the thickness t and the width w) of the casting M3 by the second shape regulating member 302. Therefore, it is possible to further improve the dimensional accuracy of the casting.

In addition, in the third embodiment, similar to the second embodiment, the thickness t and the width w of the casting M3 in the solidification interface may be measured, and the thickness and the width of the kept melt M2 immediately below the solidification interface may finely be adjusted in accordance with these measured values. In this way, it is possible to further improve the dimensional accuracy of the casting M3.

Meanwhile, as for the particular aluminum alloy (for example, aluminum alloy A6063), there is a problem that the oxide film formed on the surface of the kept melt M2 is caught in the casting M3 and a wave-shaped trace is thereby formed on the surface of the casting M3. In the third embodiment, since the second shape regulating member 302 functions as a scraper, it is possible to suppress the oxide film formed on the surface of the kept melt M2 from being caught in the casting M3. In other words, it is possible to suppress the wave-shaped trace from being formed on the surface of the casting M3 and thus possible to improve a surface property. It should be noted that the problem of the above-described wave-shaped trace does not arise to aluminum alloy ADC12, for example.

It should be noted that the shape regulating member 202 that is similar to the one in the second embodiment may be used instead of the first shape regulating member 102. In other words, a configuration in which the dimensions (the thickness t1 and the width w1) of the melt passing section 103 of the first shape regulating member can be changed may be adopted.

Fourth Embodiment

Figure 12:
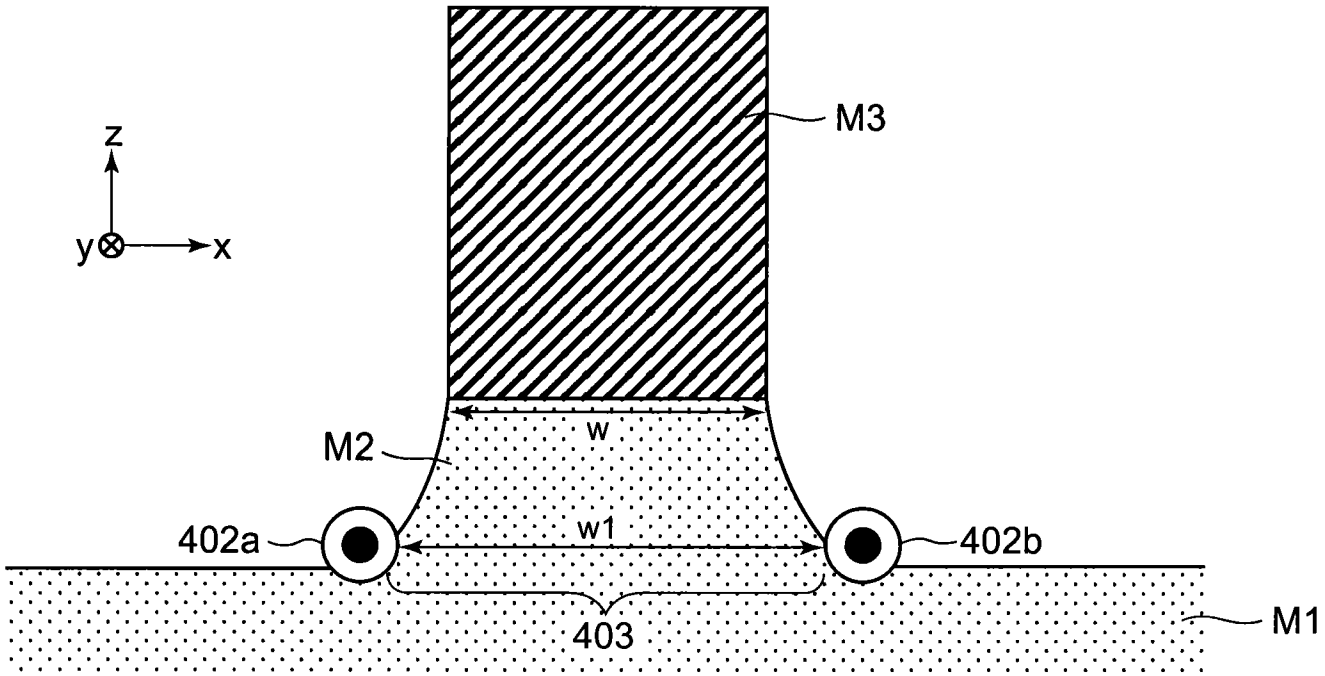
FIG. 12 is a schematic cross-sectional view of a free casting device according to a fourth embodiment.
Figure 13:
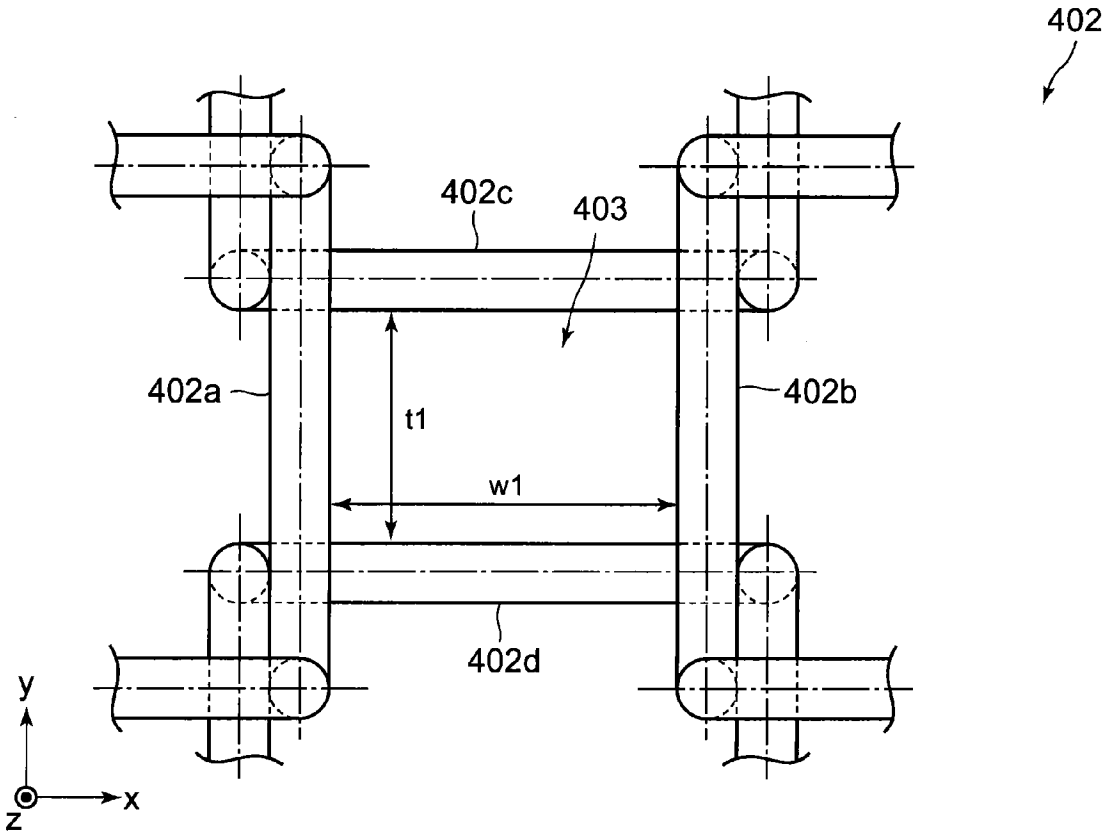
FIG. 13 is a plan view of a shape regulating member according to the fourth embodiment.
Figure 14:
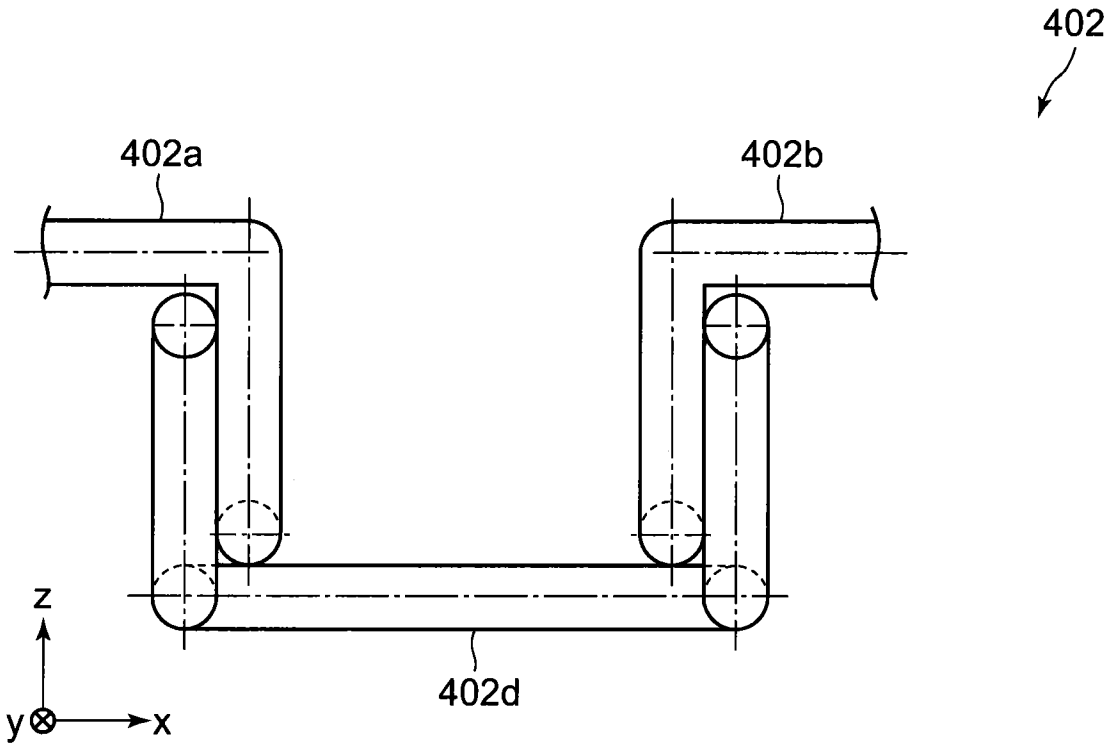
FIG. 14 is a side view of the shape regulating member according to the fourth embodiment.

Next, a description will be made on a free casting device according to a fourth embodiment with reference to FIGS. 12 to 14. FIG. 12 is a schematic cross-sectional view of the free casting device according to the fourth embodiment. FIG. 13 is a plan view of a shape regulating member according to the fourth embodiment. FIG. 14 is a side view of the shape regulating member according to the fourth embodiment. It should be noted that xyz coordinates in FIGS. 12 to 14 also correspond to those in FIG. 1.

The shape regulating member 202 according to the second embodiment, which is shown in FIG. 7, is constructed of the four rectangular shape regulating plates 202*a*, 202*b*, 202*c*, 202*d*. Meanwhile, as shown in FIG. 13, a shape regulating member 402 according to the fourth embodiment includes four shape regulating pipes 402*a*, 402*b*, 402*c*, 402*d*. With such a configuration, a thickness t1 and a width w1 of a melt passing section 403 can be changed. In addition, the four shape regulating pipes 402*a*, 402*b*, 402*c*, 402*d* can synchronously move in the z-axis direction.

Each of the shape regulating pipes 402*a*, 402*b*, 402*c*, 402*d* is a pipe in which a heater wire (a heating element) such as a nichrome wire is mounted. In other words, the shape regulating member 402 according to the fourth embodiment includes heating means therein. As the heater wire, the nichrome wire with a diameter of approximately 0.3 mm is preferred, for example. The heater wire is coated with an insulator such as magnesia and loaded in a stainless steel pipe with an outer diameter of approximately 1.5 mm. In addition, a release agent such as boron nitride may be applied to a surface of each of the shape regulating pipes 402*a*, 402*b*, 402*c*, 402*d*, so as to degrade wettability with the melt.

As shown in FIG. 13, each of the shape regulating pipes 402*a*, 402*b* includes one y-direction extending section that extends in the y-axis direction, two z-direction extending sections that are vertically arranged from both ends of the y-direction extending section (that is, that extend in the z-axis direction), and two x-direction extending sections that respectively extend in the x-axis direction from one ends of the z-axis extending sections.

The shape regulating pipes 402*a*, 402*b* are arranged in line symmetry with a linear line parallel with the y-axis being a symmetrical axis. Here, the y-direction extending section of the shape regulating pipe 402*a* and the y-direction extending section of the shape regulating pipe 402*b* are arranged to face each other.

In addition, as shown in FIG. 14, the shape regulating pipes 402*a*, 402*b* are arranged at the same height in the z-axis direction. A space between the y-direction extending section of the shape regulating pipe 402*a* and the y-direction extending section of the shape regulating pipe 402*b* regulates the width w1 of the melt passing section 403. Then, since the shape regulating pipes 402*a*, 402*b* can independently move in the x-axis direction, the width w1 can be changed.

Furthermore, as shown in FIG. 13, each of the shape regulating pipes 402*c*, 402*d* includes the one x-direction extending section that extends in the x-axis direction, the two z-direction extending sections that are vertically arranged from both ends of the x-direction extending section (that is, that extend in the z-axis direction), and the two y-direction extending sections that respectively extend in the y-axis direction from one ends of the z-axis extending sections.

The shape regulating pipes 402*c*, 402*d* are arranged in line symmetry with a linear line parallel with the x-axis being a symmetrical axis. Here, the x-direction extending section of the shape regulating pipe 402*c* and the x-direction extending section of the shape regulating pipe 402*d* are arranged to face each other.

Moreover, the shape regulating pipes 402*c*, 402*d* are arranged at the same height in the z-axis direction. A space between the x-direction extending section of the shape regulating pipe 402*c* and the x-direction extending section of the shape regulating pipe 402*d* regulates the thickness t1 of the melt passing section 403. Then, since the shape regulating pipes 402*c*, 402*d* can independently move in the y-axis direction, the thickness t1 can be changed.

As shown in FIG. 14, each of the shape regulating pipes 402*a*, 402*b* is arranged to contact upper sides of the shape regulating pipes 402*c*, 402*d*.

Since the rest of the configuration is the same as that in the second embodiment, a detailed description thereon will not be made.

As it has been described in the first embodiment with reference to FIG. 6, when the solidification interface determined by the image analysis section 110 is below the lower limit, the casting control section 111 increases the hoisting speed of the hoist 108, increases the setting temperature of the melt keeping furnace 101, or reduces the flow rate of the cooling gas supplied from the cooling gas supply section 107. In the fourth embodiment, the shape regulating member 402 is constructed of a heater. Thus, in addition to the above three options, the kept melt M2 can be heated by the shape regulating member 402. In this case, a temperature of the kept melt M2 can be increased in higher response than in the case where the setting temperature of the melt keeping furnace 101 is increased, and the position of the solidification interface can thereby be controlled. In addition, compared to a case where the heater is in a plate shape, a volume of the heater itself can be reduced when the heater is in a pipe shape.

It should be noted that, instead of using the shape regulating pipes 402*a*, 402*b*, 402*c*, 402*d* as the heaters, the cooling gas may flow through the shape regulating pipes 402*a*, 402*b*, 402*c*, 402*d*, and thus the shape regulating pipes 402*a*, 402*b*, 402*c*, 402*d* may be used as coolers. In other words, the shape regulating member 402 may include cooling means therein. As it has been described in the first embodiment with reference to FIG. 6, when the solidification interface determined by the image analysis section 110 exceeds the upper limit, the casting control section 111 reduces the hoisting speed of the hoist 108, lowers the setting temperature of the melt keeping furnace 101, or increases the flow rate of the cooling gas supplied from the cooling gas supply section 107. If the shape regulating member 402 is constructed of the cooler, in addition to the above three options, the kept melt M2 can be cooled by the shape regulating member 402. In this case, the temperature of the kept melt M2 can be lowered in higher response than in the case where the setting temperature of the melt keeping furnace 101 is lowered, and the position of the solidification interface can thereby be controlled.

It should be noted that the invention is not limited to the above embodiments and can appropriately be changed within the range of the gist thereof.

The disclosure of Japanese Patent Application No. 2012-256512 filed on Nov. 22, 2012 including the specification, drawings and abstract is incorporated herein by reference in its entirety.

DESCRIPTION OF THE REFERENCE NUMERALS AND SYMBOLS

101/ MELT KEEPING FURNACE
102, 202, 302, 402/ SHAPE REGULATING MEMBER
103, 203, 403/ MELT PASSING SECTION
104/ SUPPORT ROD
105/ ACTUATOR
106/ COOLING GAS NOZZLE
107/ COOLING GAS SUPPLY SECTION
108/ HOIST
109/ IMAGING SECTION
110/ IMAGE ANALYSIS SECTION
111/ CASTING CONTROL SECTION SHAPE REGULATING MEMBER
202*a* to 202*d*, 302*a* to 302*d*/ SHAPE REGULATING PLATE
402*a* to 402*d*/ SHAPE REGULATING PIPE
A1, A2/ ACTUATOR
G11, G12, G21, G22/ LINEAR GUIDE
M1/ MELT
M2/ KEPT MELT
M3/ CASTING
R1, R2/ ROD
S1/ LASER DISPLACEMENT GAUGE
S2/ LASER REFLECTION PLATE
ST/ STARTER
T1, T2/ SLIDE TABLE

The invention claimed is:

1. A hoisting continuous casting device comprising:
a keeping furnace that keeps a melt;
a first shape regulating member mounted in the vicinity of a molten surface of the melt that is kept in the keeping furnace and regulating a cross-sectional shape of a casting to be casted by the melt passing therethrough;
an imaging section that captures an image of the melt that has passed through the first shape regulating member;
an image analysis section that detects swinging motion in the melt from the image and determines a solidification interface based on presence or absence of the swinging motion; and
a casting control section that changes a casting condition when the solidification interface determined by the image analysis section is not within a predetermined reference range.

2. The hoisting continuous casting device according to claim 1, wherein
the casting control section changes a flow rate of cooling gas for cooling the melt that has passed through the first shape regulating member as the casting condition.

3. The hoisting continuous casting device according to claim 1, wherein
the casting control section changes a hoisting speed of the as the casting condition.

4. The hoisting continuous casting device according to claim 1, wherein
the casting control section changes a setting temperature of the keeping furnace as the casting condition.

5. The hoisting continuous casting device according to claim 1, wherein
the first shape regulating member is constructed of a pipe and either heats or cools the melt.

6. The hoisting continuous casting device according to claim 5, wherein
a heating element is loaded in the pipe and heats the melt.

7. The hoisting continuous casting device according to claim 5, wherein
cooling gas flows through the pipe and cools the melt.

8. The hoisting continuous casting device according to claim 1 further comprising
a second shape regulating member provided in the vicinity and a lower side of the solidification interface.

9. The hoisting continuous casting device according to claim 8, wherein
the second shape regulating member is driven in an up-down direction in accordance with a position of the solidification interface.

10. The hoisting continuous casting device according to claim 1, wherein
the first shape regulating member is divided into plural elements,
the image analysis section detects a dimension of the casting from the image, and
the casting control section changes the cross-sectional shape that is regulated by the first shape regulating member on the basis of the dimension of the casting.

11. A hoisting continuous casting method comprising:
allowing a melt that is kept in a keeping furnace to pass through a first shape regulating member that regulates a cross-sectional shape of a casting to be casted and hoisting the melt;
capturing an image of the melt that has passed through the first shape regulating member;
detecting swinging motion in the melt from the image and determining a solidification interface based on presence or absence of the swinging motion; and
changing a casting condition when the determined solidification interface is not within a predetermined reference range.

12. The hoisting continuous casting method according to claim 11, wherein
in changing the casting condition, a flow rate of cooling gas for cooling the melt that has passed through the first shape regulating member is changed as the casting condition.

13. The hoisting continuous casting method according to claim 11, wherein
in changing the casting condition, a hoisting speed of the casting is changed as the casting condition.

14. The hoisting continuous casting method according to claim 11, wherein
in changing the casting condition, a setting temperature of the keeping furnace for keeping the melt is changed as the casting condition.

15. The hoisting continuous casting method according to claim 11, wherein
the first shape regulating member is constructed of a pipe, and the melt is either heated or cooled by the first shape regulating member.

16. The hoisting continuous casting method according to claim 15, wherein
a heating element is loaded in the pipe and heats the melt.

17. The hoisting continuous casting method according to claim 15, wherein cooling gas flows through the pipe and cools the melt.

18. The hoisting continuous casting method according to claim 11, wherein the melt that has passed through the first shape regulating member passes through a second shape regulating member provided in the vicinity and a lower side of the solidification interface.

19. The hoisting continuous casting method according to claim 18, wherein the second shape regulating member is driven in an up-down direction in accordance with a position of the solidification interface.

20. The hoisting continuous casting method according to claim 11, wherein the first shape regulating member is configured to be divided into plural elements, a dimension of the casting is detected from the image, the cross-sectional shape that is regulated by the first shape regulating member is changed based on said dimension.

* * * * *